United States Patent [19]

Morishita et al.

[11] Patent Number: 5,000,054

[45] Date of Patent: Mar. 19, 1991

[54] ENGINE STARTER WITH A CORROSION RESISTANT BEARING

[75] Inventors: Akira Morishita; Shuzoo Isozumi, both of Himeji, Japan

[73] Assignee: Mitsubishi Denki Kabushiki Kaisha, Tokyo, Japan

[21] Appl. No.: 397,948

[22] Filed: Aug. 24, 1989

[30] Foreign Application Priority Data

Aug. 25, 1988 [JP] Japan ..... 63-112357

[51] Int. Cl.[5] ..... F02N 11/00

[52] U.S. Cl. ..... 74/6; 74/7 R; 123/179 M; 290/48

[58] Field of Search ..... 74/6, 7 R; 123/179 M; 290/38 R, 38 C, 48

[56] References Cited

U.S. PATENT DOCUMENTS

| | | | |
|---|---|---|---|
| 4,404,533 | 9/1983 | Kurihara et al. | 335/131 |
| 4,563,223 | 1/1986 | Dawes et al. | 148/16.5 |
| 4,613,761 | 9/1986 | Yabunaka | 290/36 R |
| 4,760,274 | 7/1988 | Isozumi | 290/48 |
| 4,855,610 | 8/1989 | Morishita et al. | 74/7 A |
| 4,886,306 | 12/1989 | Tanaka et al. | 74/7 R |
| 4,899,603 | 2/1990 | Isozumi et al. | 74/7 A |
| 4,931,663 | 6/1990 | Morishita et al. | 74/7 A |

*Primary Examiner*—Leslie A. Braun
*Assistant Examiner*—Scott Anchell
*Attorney, Agent, or Firm*—Sughrue, Mion, Zinn, Macpeak and Seas

[57] ABSTRACT

An engine starter suitable to be used under severe corrosive conditions is disclosed, wherein the inner race of the ball bearing for supporting the pinion driving shaft is made of a martensitic stainless steel hardened by a heat treatment, which is effective in maintaining a good sliding contact between the inner race of the bearing and the pinion driving shaft. The balls of the bearing may be covered by a seal at both open sides thereof; further, the front open end of the pinion may be closed by a cap.

3 Claims, 2 Drawing Sheets

ENGINE STARTER WITH A CORROSION RESISTANT BEARING

BACKGROUND OF THE INVENTION

This invention relates to starters for internal combustion engines, and more particularly to the overhang type starters in which the pinion is positioned in front of (i.e., to the outside of) the bearing for rotatably supporting the pinion driving shaft carrying the pinion.

The overhang type starters for internal combustion engines are particularly liable to develop rust on the bearing rotatably supporting the pinion driving shaft. In order to make clear the reason therefore, let us first desribe the organization of such a starter, referring to FIG. 1 of the drawings.

FIG. 1 shows the structure of the portion around the bearing of such a starter in an axial cross section. In FIG. 1, an output shaft 1 is coupled via a planetary reduction gear device 2 to the rotational shaft 3 of the armature of the starter electric motor (not shown); on the rear outer circumferential surface of the output shaft 1 are formed helical splines 1*a* to which an overrunning clutch 4 is engaged at its inner surface, to be slidable in the axial direction. A pinion driving shaft 5, formed of a hardened quenched steel and disposed slidably on the output shaft 1, carries a pinion 6 formed integrally therewith at its front end. The overruning clutch 4 and the pinion driving shaft 5 with its pinion 6 constitute the pinion assembly supported axially slidably on the output shaft 1. A ball bearing 7, made of a case hardened steel, comprises: an annular inner race 7*a* in slidable contact with the pinion driving shaft 5; an annular outer race secured to a front bracket 8 of the starter; and a plurality of balls 7*c* rolling therebetween; thus, the bearing 7 supports rotatably and axially slidably the pinion driving shaft 5. Further, a pair of metallic sleeves 9 are disposed between the output shaft 1 and the pinion driving shaft 5 so as to allow rotational and axial sliding movements of the pinion driving shaft 5 with respect to the output shaft 1. A stopper 10 is secured to the front end portion of the output shaft 1 via a ring 11 to limit the forward (toward right in the figure) movement of the pinion 6 by abutting on the stepped portion 5*a*of the pinion driving shaft 5 formed on its interior side surface. An electromagnetic switch 12 shifts the pinion assembly via a lever 13, which is pivoted at its middle and is coupled at its upper end to the armature or plunger 14 of the electromagnetic switch 12 and at its lower end to the rear side of the overrunning clutch 4.

The operation of the starter of FIG. 1 is as follows. When an electric current is supplied to the electromagnetic switch 12 from a storage battery, etc., the plunger 1 is attracted by the resulting magnetic force toward left in the figure; thus, the lever 13 rotates counterclockwise to drive and shift forward the overrunning clutch 4 and the pinion driving shaft 5, so that the pinion 6 is brought into engagement with the ring gear (not shown) of the engine. Further, due to the action of the electromagnetic switch 12, the starter motor is supplied with an energization current to develop a torque; the resulting rotation of the motor is transmitted via the planetary reduction gear device 2 to the output shaft 1, and further, to the pinion driving shaft 5 via the overrunning clutch 4; thus, the resulting rotation of the pinion 6 starts the engine.

As point out first, the above type of starters suffer from the development of rust on the bearing. Namely, when water containg mud or salt is splashed upon the starter, as often happens in the case of the starter attached, for example, to an automotive engine or an outboard engine of a small boat, this corrosive water enters from the front opening to the interior portion at which the bearing 7 is located. This eventually results in the development of rust on the bearing 7. As a result, the smooth sliding contact between the inner race of the bearing 7 and the pinion driving shaft 5 is impaired.

SUMMARY OF THE INVENTION

Thus, it is a primary object of this invention to provide an engine starter in which the smooth sliding contact between the pinion driving shaft carrying the pinion and the inner race of the ball bearing rotatably supporting it is maintained for a long period of time even under a severe operation condition where water containing mud or salt is often splashed on the starter.

The above object is accomplished according to this invention by an engine starter in which at least the inner race of the ball bearing rotatably supporting the pinion driving shaft is made of a martensite stainless steel hardened by a heat treatment.

The martensite stainless steel hardened by a heat treatment is not only resistant to the development of corrosion, but also exhibits enough mechanical strength required for a material of the bearing. Thus, the ball bearing of the starter according to this invention is enhanced in durability and is resisitant to the development of rust, being capable of maintaining good sliding contact with the pinion driving shaft even after a repeated exposure to water containing mud or salt.

BRIEF DESCRIPTION OF THE DRAWINGS

The novel features which are believed to be characteristic of this invention are set forth with particularity in the appended claims. This invention itself, however, both as to its structure and operation, together with further objects and advantages thereof, may best be understood from the following detailed description taken in connection with the accompanying drawings, in which:

In the drawings, like reference numerals represent like or corresponding parts.

DETAILED DESCRIPTION OF THE PREFERRED EMBODIMENTS

Let us now describe preferred embodiments according to this invention by reference to attached drawings.

Figure 1:
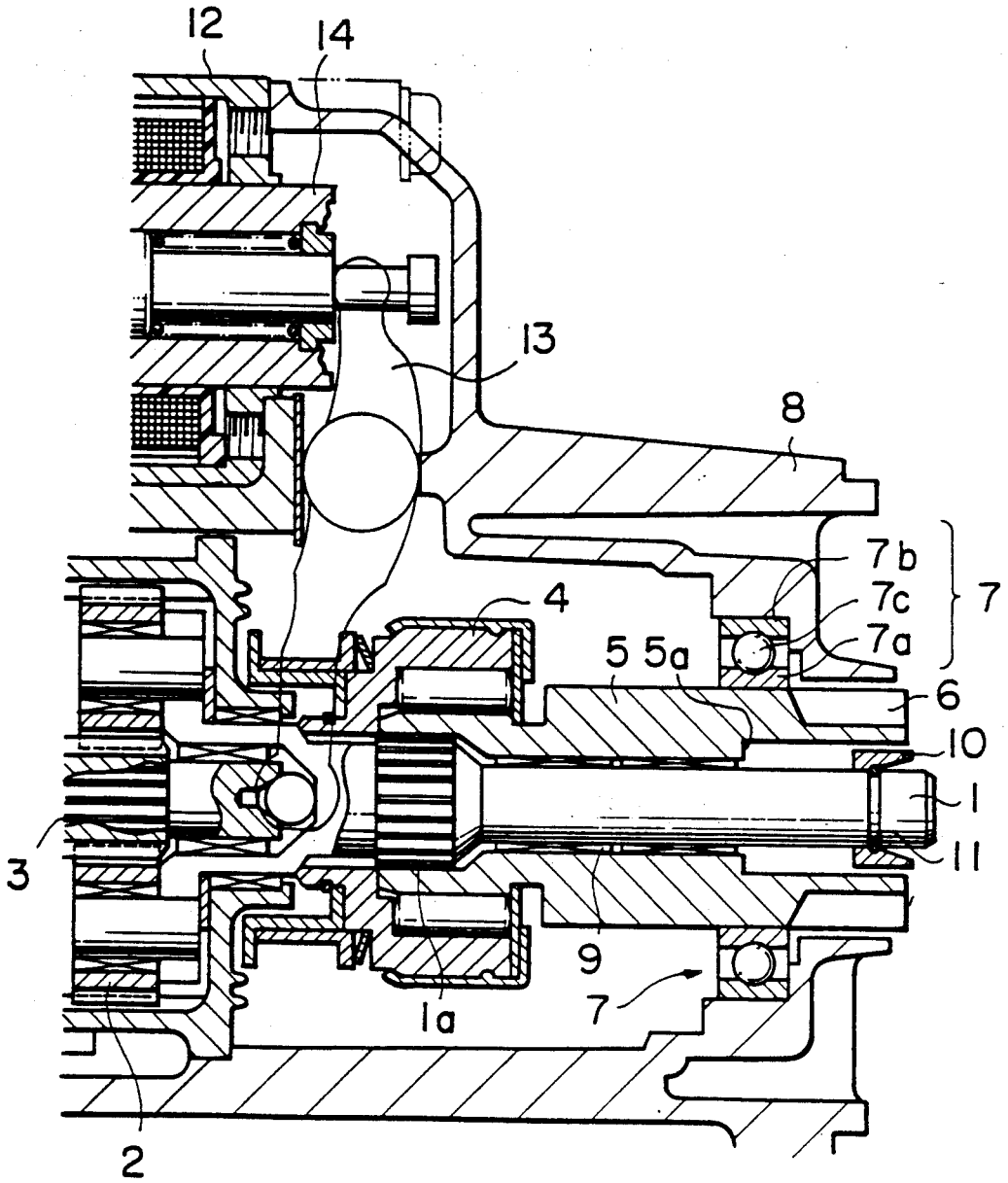
FIG. 1 is a partial axial cross sectional view of an engine starter according to a first embodiment of this invention.

The starter according to a first embodiment of this invention is structurally similar to that shown in FIG. 1 and described above; thus, let us refer again to FIG. 1. The difference between the above described starter and the starter according to the first embodiment of this invention lies in the material of the inner race 7*a* of the ball bearing 7; namely, the inner race 7*a* of the ball bearing 7 according to this invention is made of a martensitic stainless steel subjected to a hardening heat treatment. Otherwise, the starter according to the first embodiment is similar to that described above in its structure and operation.

Martensite stainless steels, which typically contains carbon (C) in the range of from 0.15 to 0.65%, chromium (Cr) from 16 to 25%, nickel (Ni) from 1 to 3%, and silicon (Si) and manganese (Mn) under 1%, are not only resistant to the development of corrosion but are capable of being hardened by a heat treatment. The effect of utilizing a martensitic stainless steel as the material of the inner race *7a* of the ball bearing 7 on the operation of the starter is as follows. The inner race *7a* of the ball bearing 7 in slidable contact with the pinion driving shaft 5 is made resistant to the development of rust. Thus, even when water containing mud or salt enters into the interior of the starter, the sliding inner surface of inner race *7a* of the ball bearing 7 develops hardly any rust, and thus the smooth sliding contact between the pinion driving shaft 5 and the inner race *7a* of the ball bearing 7 is maintained. In addition, since the martensitic stainless steel of which the inner race *7a* is made is hardened by a heat treatment, the bearing 7 is capable of supporting a large load and enduring a high speed rotation. As a result, even after a long period of operation under severe conditions, the smooth siding contact and the durabililty of the bearing 7 is maintained; thus, the reliability of the starter is enhanced.

Figure 2:
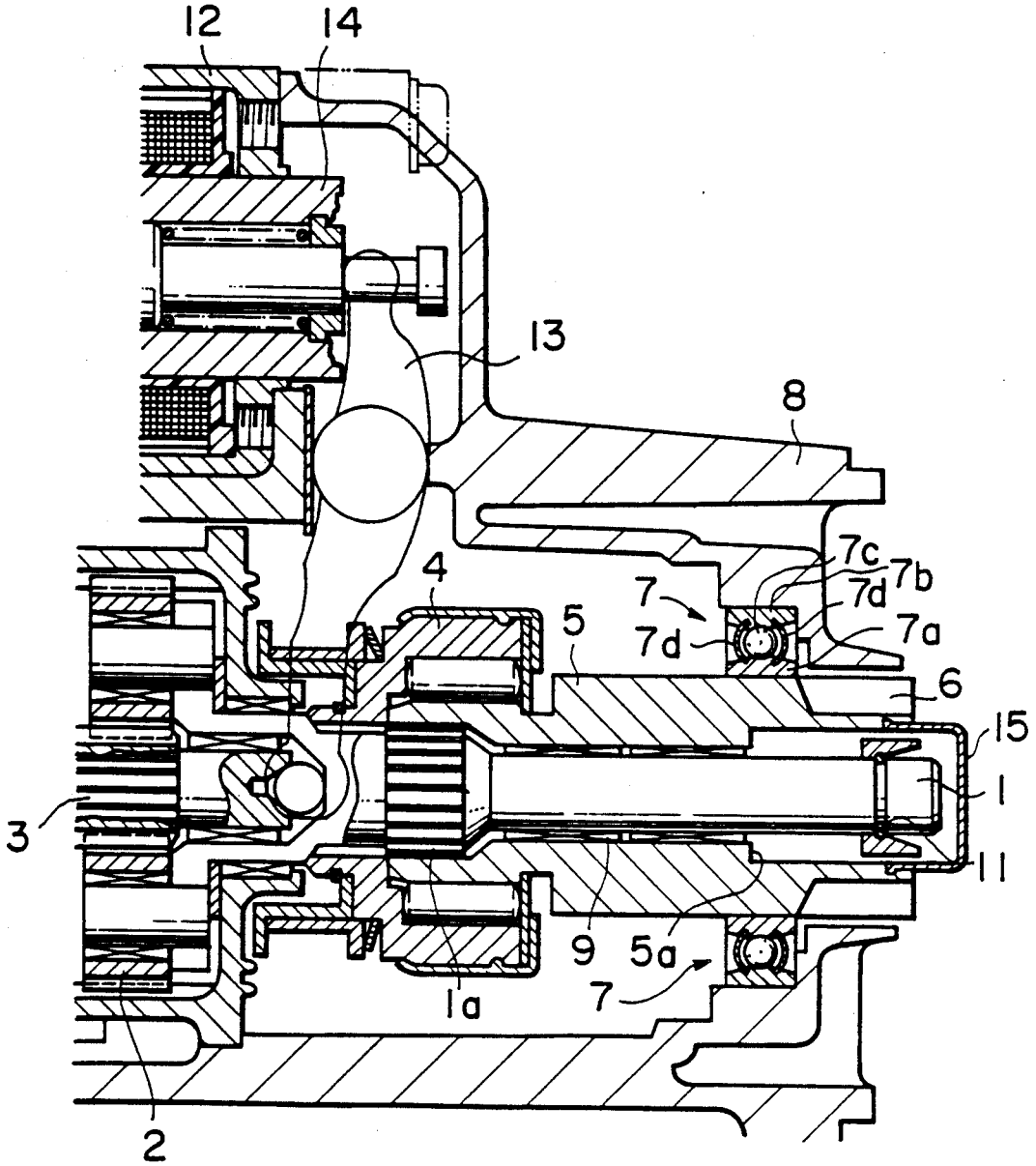
FIG. 2 is a view similar to that of FIG. 1, but showing an engine starter according to a second embodiment of this invention.

FIG. 2 shows a starter according to a second embodiment of this invention. In the case of this starter, the ball bearing 7, whose inner race *7a* is made of a martensite stainless steel hardenedd by heat treatment as in the above case, comprises a seal *7d* covering the balls *7c* at both front and rear open sides thereof; further, a cap 15 attached to the front end of the pinion 6 closes the opening at the front end thereof. Furthermore, the outer circumferential surface of the pinion driving shaft 5 in sliding contact with the inner race *7a* of the ball bearing 7 is plated with chromium. Otherwise, the starter of FIG. 2 is similar to that according to the first embodiment.

The starter of FIG. 2 has following additional advantages: Since the front opening of the pinion 6 is covered by the cap 15, the annular gap between the pinion driving shaft 5 and the output shaft 1 is protected from the intrusion of water and dust; further, since the ball bearing 7 is provided with a seal *7d*, the rolling portion thereof is effectively protected from the intrusion of water or dust. Furthermore, since the sliding surface of the pinion driving shaft 5 is plated with chromium, the deterioration of the sliding contact between the inner race *7a* of the ball bearing 7 and the pinion driving shaft 5 proceeds still more slowly. Thus, the starter according to the second embodiment is especially suited to be used under severe conditions where, as when attached to an outboard internal combustion engine of a small vessel, the starter is attached in a position and attitude in which the pinion 6 points upward and a large amount of see water is splashed frequently thereupon.

The starter of FIG. 2 is capable of being modified: Although the front opening of the pinion 6 is covered by a cap 15 in the case of the starter of FIG. 2, the pinion 6 may comprises in its stead an integrally formed front end wall closing the interior thereof. Further, for the purpose of enhancing the water-and dust-proof structure as described above, drain holes for leading out the intruding water may be formed in the front bractet 8 at a position in front (i.e., to the right side in the figure) of the ball bearing 7.

In the case of the above embodiments, only the inner race *7a* of the ball bearing 7 is made of a matensite stainless steel; however, the outer race *7b* and the balls *7c* of the ball bearing 7 may also be formed of a martensite stainless steel. Further, although the pinion 6 is formed integrally with the pinion driving shaft 5 in the above embodiments, the present invention is applicable to the case where a separately formed pinion 6 is secured to the front end of the pinion driving shaft 5. Furthermore, for the purpose of enhancing and maintaining the smooth sliding contact between the inner race *7a* of the ball bearing 7 and the pinion driving shaft 5, grooves for holding and retaining lubricating grease may be formed on the inner circumferential surface of the inner race *7a*. Still further, although the above embodiments comprises a planetary reduction gear mechanism, the present invention is applicable to the starters in which the reduction gear is of a different kind, or even is omitted.

What is claimed is:

1. An engine starter for starting an internal combustion engine, comprising:

a frame;

an electric motor having an output shaft;

a pinion assembly axially slidably mounted on said output shaft of the motor, said pinion assembly including a pinion adapted to be engaged with a driven gear of the internal combustion engine, and a hollow cylindrical pinion driving shaft carrying said pinion at a front end thereof;

means for axially shifting said pinion assembly on said output shaft of the motor; and a ball bearing secured to the frame at an outer race thereof and in sliding contact with said pinion driving shaft at an inner race thereof, wherein at least said inner race is made of a martensite stainless steel hardened by a heat treatment.

2. An engine starter as claimed in claim 1, further comprising a seal covering balls of the ball bearing at both open sides thereof.

3. An engine starter as claimed in claim 1 or 2, wherein a front open end of the pinion is closed by a cap.

* * * * *